US011107647B1

(12) United States Patent
Gottschalk et al.

(10) Patent No.: US 11,107,647 B1
(45) Date of Patent: Aug. 31, 2021

(54) SOLID STATE CIRCUIT INTERRUPTER WITH INTERLOCK

(71) Applicant: EATON INTELLIGENT POWER LIMITED, Dublin (IE)

(72) Inventors: Andrew L. Gottschalk, Monaca, PA (US); Xin Zhou, Wexford, PA (US); Robert Michael Slepian, Murrysville, PA (US); David Arisumi, Coraopolis, PA (US); Santhosh Kumar, Moon Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/826,935

(22) Filed: Mar. 23, 2020

(51) Int. Cl.
*H01H 9/28* (2006.01)
*H01H 9/02* (2006.01)
*H01H 9/54* (2006.01)

(52) U.S. Cl.
CPC ..... *H01H 9/286* (2013.01); *H01H 9/0271* (2013.01); *H01H 9/548* (2013.01)

(58) Field of Classification Search
CPC ..... H01H 9/286; H01H 9/0271; H01H 9/548
USPC ..... 200/50.11
See application file for complete search history.

(56) References Cited

U.S. PATENT DOCUMENTS

| | | | | |
|---|---|---|---|---|
| 5,874,698 | A | 2/1999 | Collis | |
| 2003/0098222 | A1 | 5/2003 | Moore | |
| 2016/0141122 | A1* | 5/2016 | Darko | H01H 9/24 200/50.01 |
| 2017/0004948 | A1* | 1/2017 | Leyh | H01H 9/548 |

OTHER PUBLICATIONS

European Patent Office "International Search Report and Written Opinion", from corresponding International Application No. PCT/EP2021/025103, dated Jun. 30, 2021, 13 pp.

* cited by examiner

*Primary Examiner* — Edwin A. Leon
*Assistant Examiner* — Iman Malakooti
(74) *Attorney, Agent, or Firm* — Eckert Seamans Cherin & Mellott, LLC

(57) ABSTRACT

A solid state circuit interrupter provides structures which can manually move an isolation switch of a pole from the ON state to the OFF state without the use of auxiliary power but that advantageously additionally provides an interlock apparatus that avoids manually moving the isolation switch from the ON state to the OFF state until certain conditions exist. One such condition is to ensure that some action is taken, such as by switching a physical interlock between one state and another state. Such a change in state of the physical interlock might additionally result in a change in state of an electronic interlock that would resist the solid state switch being moved to its ON state while the isolation switch is capable of being manually switched to its OFF state. The physical interlock might additionally resist the isolation switch from being manually switched into its ON state.

18 Claims, 15 Drawing Sheets

SOLID STATE CIRCUIT INTERRUPTER WITH INTERLOCK

BACKGROUND

Field

The disclosed and claimed concept relates generally to circuit interrupters and, more particularly, to a solid state circuit interrupter with an interlock.

Related Art

Circuit interruption equipment is well known in the relevant art. Numerous types of circuit interrupters exist and typically are provided in order to open a protected portion of a circuit in certain pre-determined conditions such as over-current conditions, under-voltage conditions, fault conditions, and other conditions. A typical circuit interrupter includes a number of poles, with each pole being connected with a line conductor and a load conductor and including a set of separable contacts that are movable between a CLOSED condition and an OPEN condition in a known fashion. As employed herein, the expression "a number of" and variations thereof, shall refer broadly to any non-zero quantity, including a quantity of one. Such circuit interrupters typically additionally include an operating mechanism that moves the sets of separable contacts between the CLOSED condition and the OPEN condition. Such circuit interrupters typically additionally include an arc extinction system that extinguishes an arc that typically forms between the contacts when moving from the CLOSED condition to the OPEN condition.

One particular type of circuit interrupter is a solid state circuit interrupter which has, for each pole, a solid state switch in place of the set of separable contacts, and each such solid state switch includes a multiple number of solid state devices that are similar to transistors and which likewise can be switched between two states to stop the flow of current between the line and load conductors. The overall set of solid state devices for each solid state switch still have some level of current leakage with voltage applied across them even when in the OPEN condition. As such, solid state circuit interrupters typically additionally include on each pole an isolation switch which is connected in series with the solid state switch of the pole and which can be moved between an ON state and an OFF state. The isolation switch provides galvanic isolation between the line and load. When the isolation switch is in its ON state and the solid state switch is likewise in its ON state, current is permitted to flow between the line and load conductors that are connected with that pole. When it is desired to stop the flow of current through that pole, the solid state switch is first moved to its OFF state, and then the isolation switch is moved to its OFF state. When the solid state circuit interrupter is desired to be switched from its OFF state to its ON state, the isolation switch is first moved from its OFF state to its ON state, and then the solid state is moved from its OFF state to its ON state. Since the isolation switch has relatively little current flowing through it when it is moved to its OFF state, the isolation switch does not require the robustness or the arc extinction system that typically is required in a conventional circuit interrupter having sets of separable contacts. As such, it would be undesirable for the isolation switch to change states when the solid state switch is in its ON state.

While such solid state interrupters have been generally effective for their intended purposes, they have not been without limitation. The solid state switch is electronically switched between its ON and OFF states. The isolation switch is typically moved between its ON and OFF states through the use of an actuation device such as a rotational solenoid that is electrically operated using auxiliary power at 24 volts DC. Situations can exist, however, in which the isolation switch is in its ON state and such auxiliary power is unavailable to move the isolation switch from the ON state to the OFF state. For instance, if the solid state circuit interrupter is delivered and the isolation switch is somehow in its ON state and such auxiliary power is unavailable, the solid state circuit interrupter cannot be put into service, which could substantially impair the value of the solid state circuit interrupter. Improvements thus would be desirable.

SUMMARY

Accordingly, an improved solid state circuit interrupter in accordance with the disclosed and claimed concept provides structures which can manually move an isolation switch of a pole from the ON state to the OFF state without the use of auxiliary power but that advantageously additionally provides an interlock apparatus that avoids manually moving the isolation switch from the ON state to the OFF state until certain conditions exist. One such condition is to ensure that some action is taken, such as by switching a physical interlock between one state and another state. Such a change in state of the physical interlock might additionally result in a change in state of an electronic interlock that would resist the solid state switch being moved to its ON state while the isolation switch is capable of being manually switched to its OFF state. The physical interlock might additionally resist the isolation switch from being manually switched into its ON state. The improved solid state circuit interrupter thus advantageously resists the isolation switch from being manually moved from its ON state to its OFF state until certain conditions exist on the solid state circuit interrupter.

Accordingly, an aspect of the disclosed and claimed concept is to provide an improved solid state circuit interrupter having an interlock apparatus which includes a physical interlock that resists an isolation switch on each pole from being moved from its ON state to its OFF state unless the physical interlock is moved from a resist state to a release state.

Another aspect of the disclosed and claimed concept is to provide such a solid state circuit interrupter in which the physical interlock, in moving from its resist state to its release state causes an electronic interlock to change from its own release state to its own resist state in which condition the electronic interlock resists the solid state switch from being switched from its OFF state to its ON state.

Another aspect of the disclosed and claimed concept is to provide a solid state circuit interrupter wherein the physical interlock is a first physical interlock which, in its resist state, additionally actuates a second physical interlock that resists the isolation switch from being switched from its OFF state to its ON state.

Another aspect of the disclosed and claimed concept is to provide a solid state circuit interrupter having an interlock apparatus wherein a tab or other structure that is situated on a housing of the solid state circuit interrupter must be moved between one state and another state to cause the interlock apparatus and its physical interlock to move from its resist state to its release state.

Accordingly, an aspect of the disclosed and claimed concept is to provide an improved solid state circuit interrupter structured to be connected with a number of line and load conductors. The solid state circuit interrupter can be generally stated as including a housing, a switching apparatus situated on the housing and that can be generally said to include an isolation switch movable between an ON state and an OFF state, an interlock apparatus situated on the housing, the interlock apparatus comprising an interlock that is movable between one state and another state, an actuator apparatus situated on the housing, the actuator apparatus comprising an actuator, the actuator in the one state of the interlock being structured to be manually movable between a free state and an actuated state to move the isolation switch from the ON state to the OFF state, the interlock in the another state resisting the actuator from moving the isolation switch from the ON state to the OFF state.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
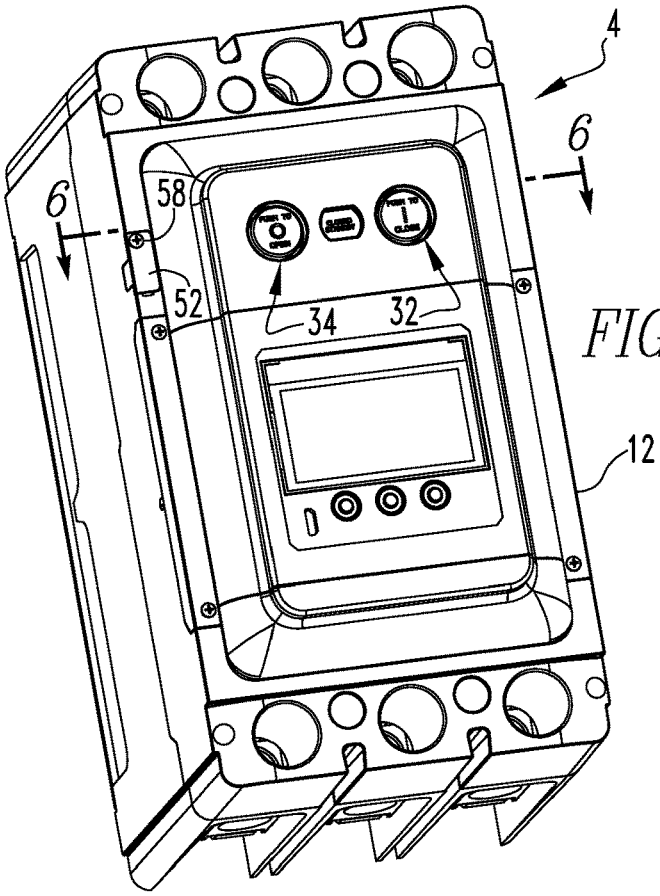
FIG. 1 is a perspective view of an improved solid state circuit interrupter in accordance with a first embodiment of the disclosed and claimed concept that has an interlock apparatus that is in a resist state, with the interlock apparatus having a tab that is in an installed state.

An improved solid state circuit interrupter 4 in accordance with a first embodiment of the disclosed and claimed concept is depicted generally in FIGS. 1-12A. The solid state circuit interrupter 4 is structured to be connected with a number of line conductors 8 and a number of load conductors 6 and is configured to interrupt current to a protected portion of a circuit that includes the line and load conductors 8 and 6.

The solid state circuit interrupter 4 can be said to include a housing 12 having an opening 14 (FIG. 2) formed therein. The solid state circuit interrupter 4 can further be said to include a switching apparatus 16, an actuator apparatus 20, and an interlock apparatus 24, each situated on the housing 12. The switching apparatus 16 can be said to include, for each pole of the solid state circuit interrupter 4, a solid state switch 28 that is movable between an ON state and an OFF state, and to further include an isolation switch 30 that is movable between an ON state and an OFF state. For each pole, the solid state switch 28 and the isolation switch 30 of that pole can be said to be electrically connected together in series between the line and load conductors 8 and 6 of that pole. In this regard, it is understood that the exemplary solid state circuit interrupter 4 includes three poles, with each of the poles having its own solid state switch 28 and isolation switch 30 electrically connected together in series. It is understood, however, that in alternative embodiments the solid state circuit interrupter in accordance with the disclosed and claimed concept can have a different number of poles without departing from the spirit of the instant disclosure.

Figure 10:
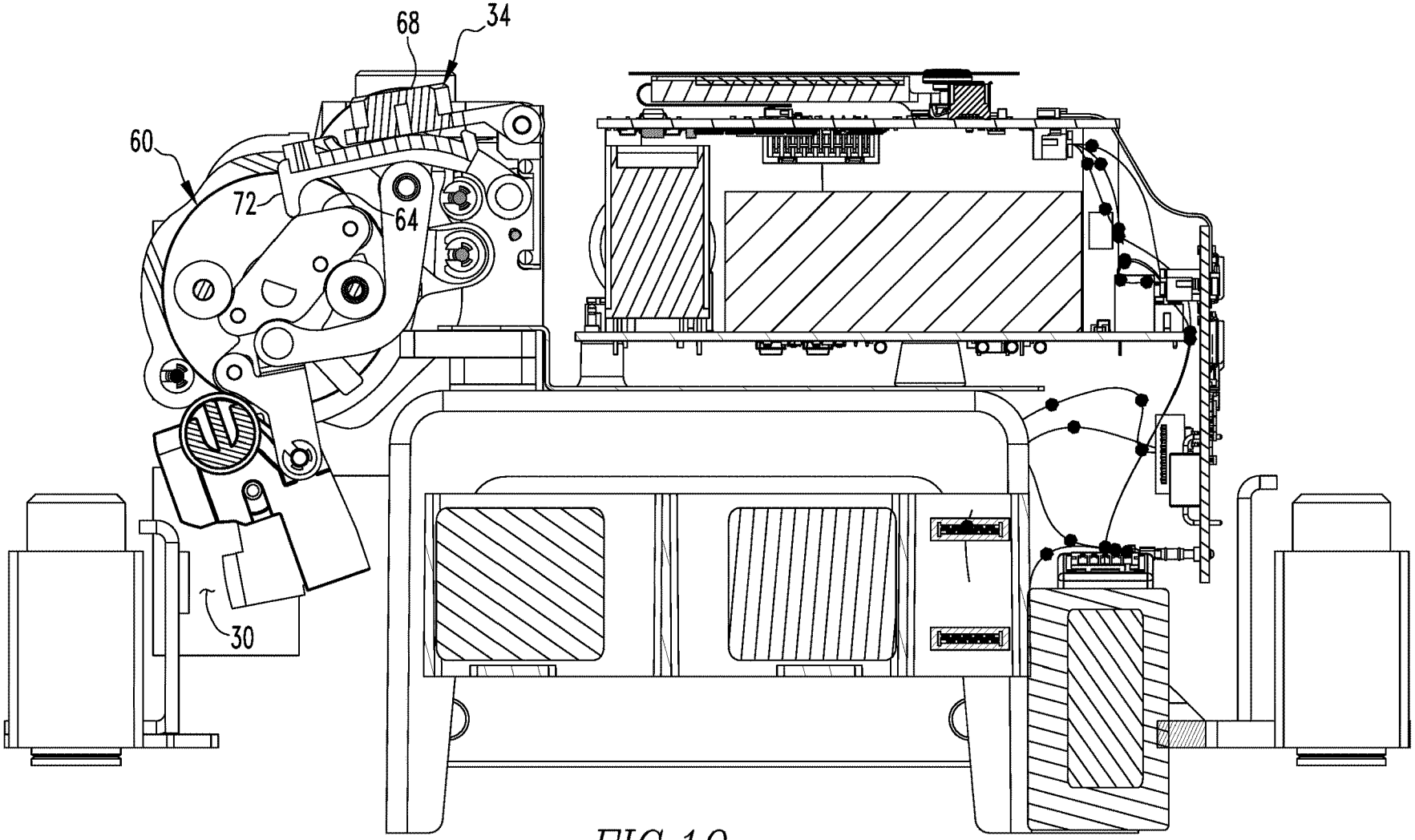
FIG. 10 is a sectional view as taken along line 10-10 of FIG. 9.

The actuator apparatus 20 can be said to include an ON actuator 32 and an OFF actuator 34. The ON and OFF actuators 32 and 34 are each manually movable between a free state, such as is depicted in FIG. 1, and an actuated state, such as is depicted in FIG. 10 in the instance of the OFF actuator 34, and each includes a biasing structure such as a spring that biases the ON and OFF actuators 32 and 34 toward the free state.

Figure 5:
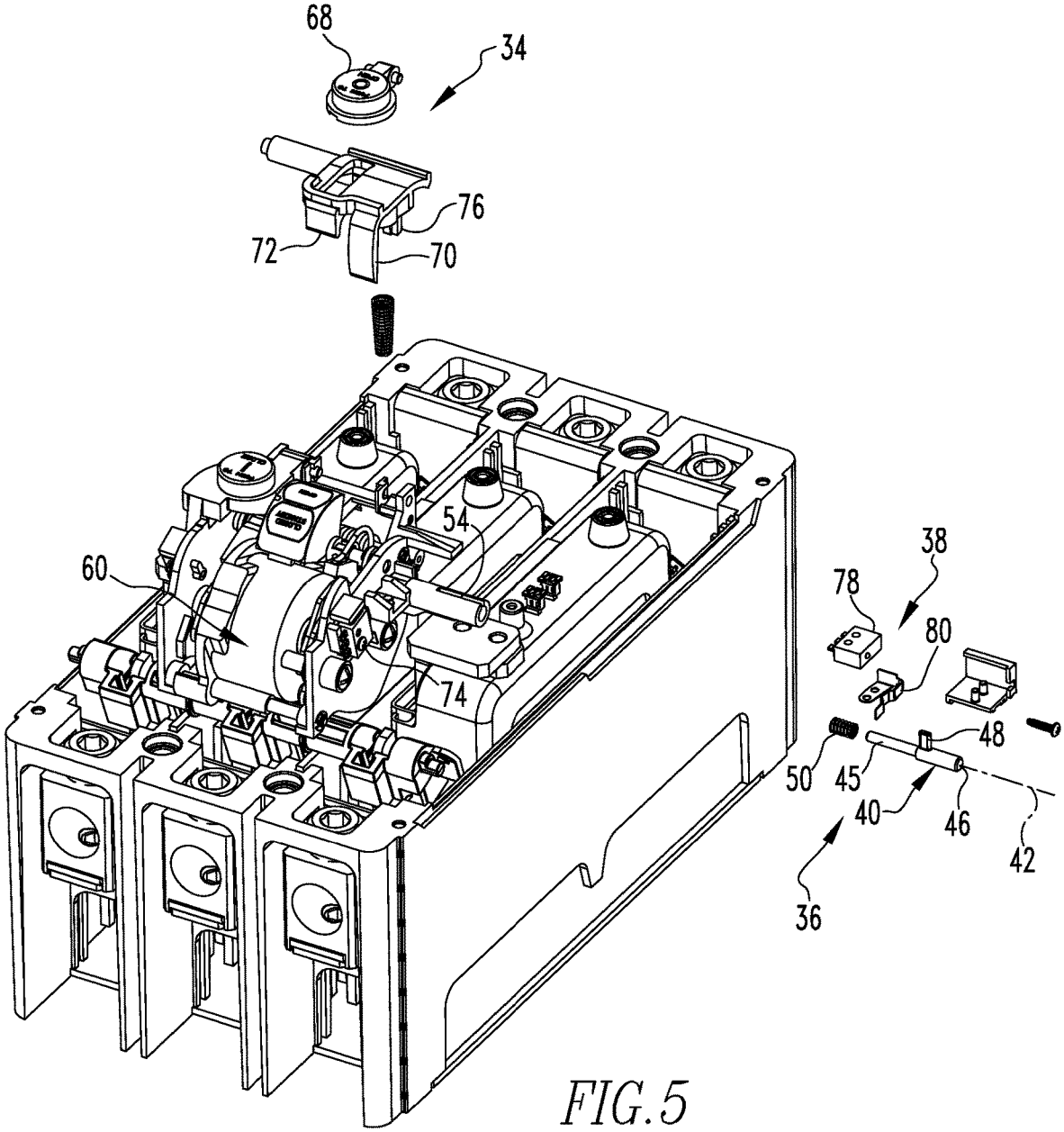
FIG. 5 is an exploded view of the first embodiment with the tab of the interlock apparatus being depicted in a removed state.

The interlock apparatus 24 can be said to include a physical interlock 36 and an electronic interlock 38 that can be said to be depicted in an exploded fashion in FIG. 5. The physical interlock 36 can be said to be movable between one state and another state, and in the depicted exemplary embodiment the one state can be said to be a release state, and the another state can be said to be a resist state. In a like fashion, the electronic interlock 38 is movable between one state and another state, but in the exemplary depicted embodiment its one state is a resist state and its another state is a release state. That is, in the depicted exemplary embodiment, the physical interlock 36 and the electronic interlock 38 are both simultaneously in the one state or are both simultaneously in the another state. Stated otherwise, in the one state, the physical interlock 36 is in the release state and the electronic interlock 38 is in the resist state. In the another state, the physical interlock 36 is in the resist state and the electronic interlock 38 is in the release state. In its resist state, the physical interlock 36 and/or the electronic interlock 38 resist some action, whereas in its release state, the physical interlock 36 and/or the electronic interlock 38 permit some action, as will be set forth in greater detail elsewhere herein.

Figure 2:
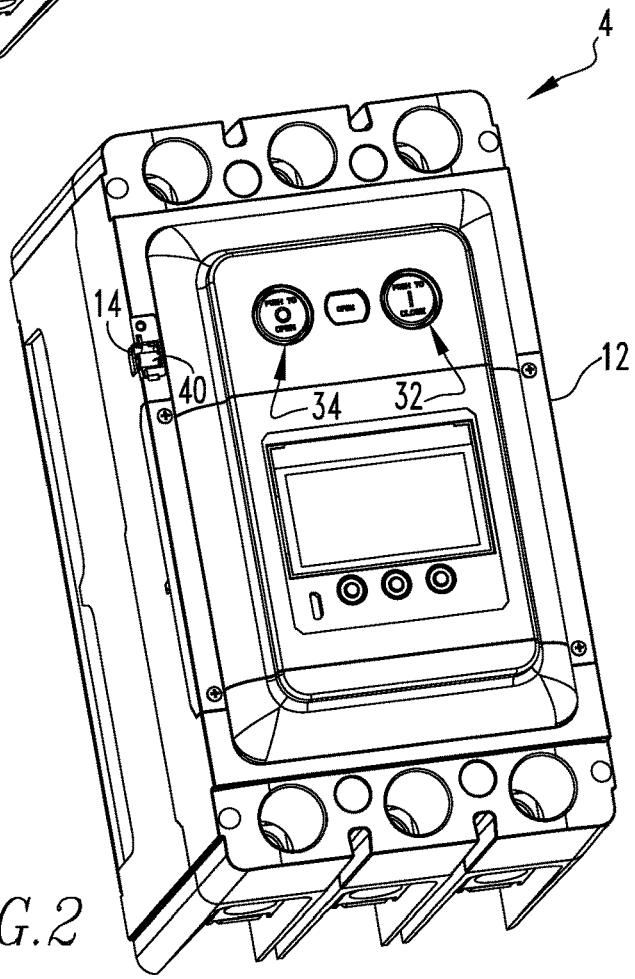
FIG. 2 is a view of the first embodiment, except with the interlock apparatus in a release state.
Figure 3:
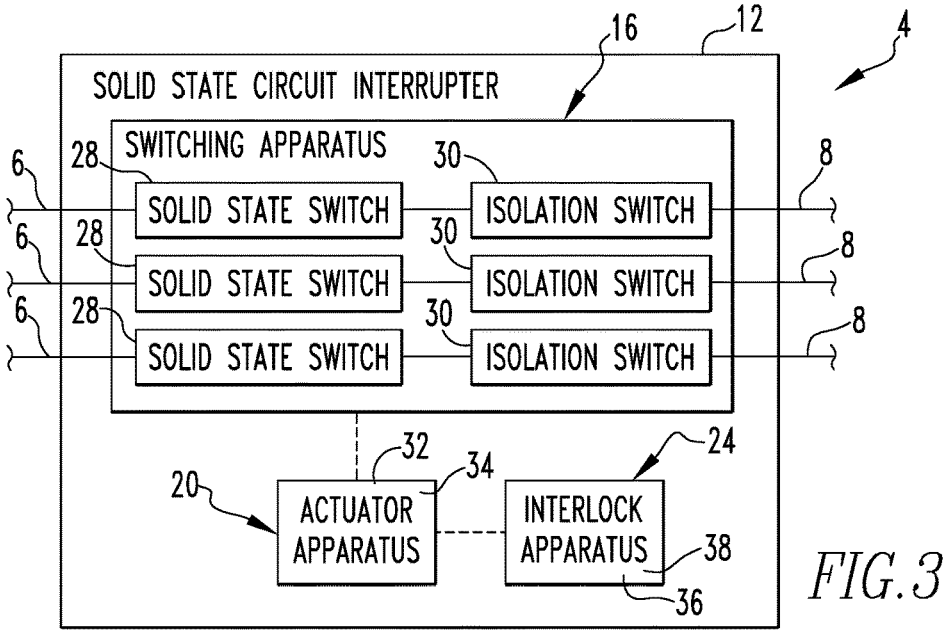
FIG. 3 is a schematic depiction of the first embodiment.
Figure 4:
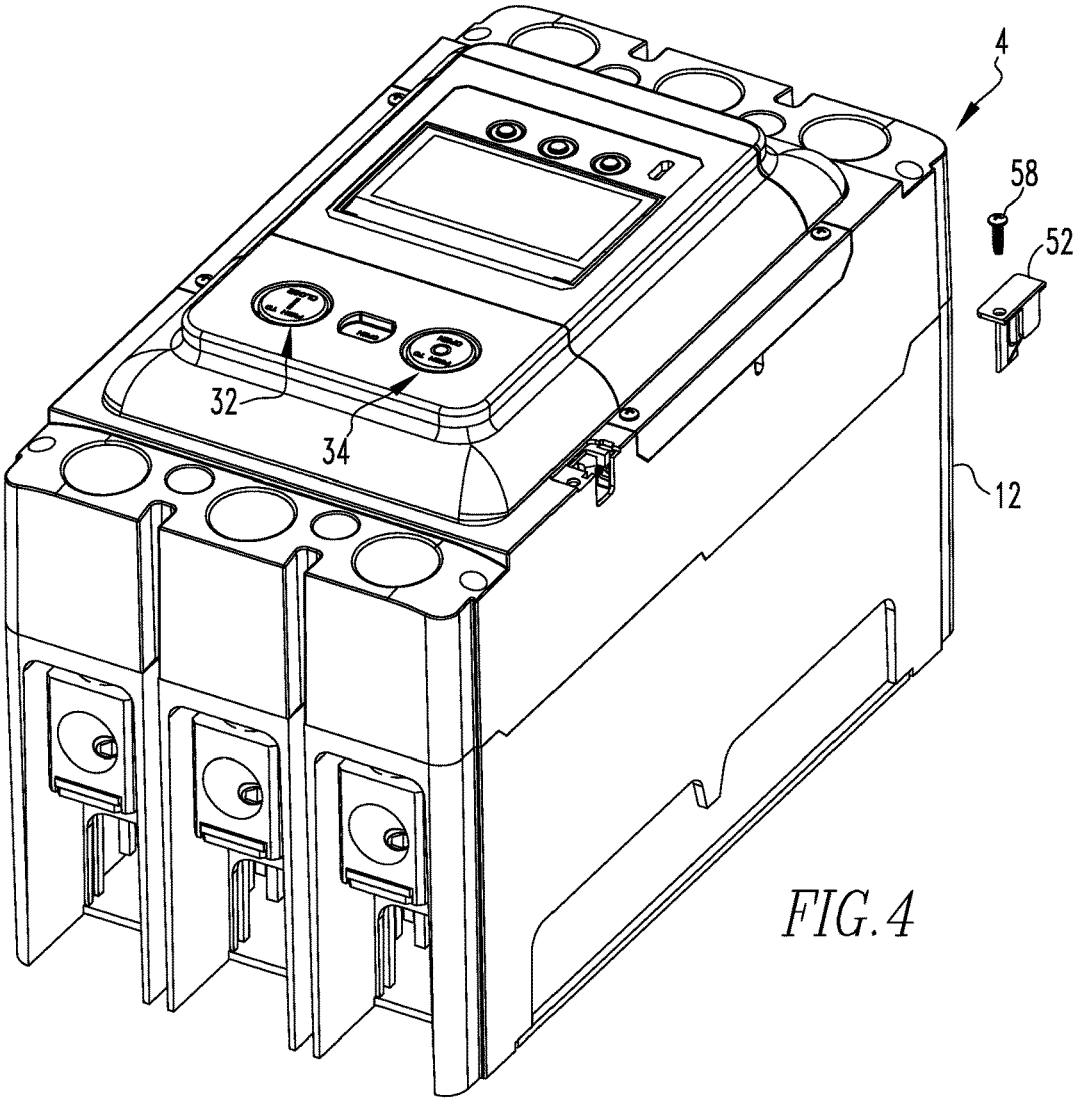
FIG. 4 is another perspective view similar to FIG. 2.

More specifically, the physical interlock 36 can be said to include a shank 40, a spring 50, and a tab 52. The tab 52 is movable between one state and another state. In the depicted exemplary embodiment, the one state of the tab 52 can be said to be a removed state wherein the tab 52 is removed from the housing 12, such as is depicted in FIGS. 2 and 4, by way of example. The another state of the tab 52 can be said to be an installed state wherein the tab 52 is received in the opening 14 and is installed on the housing 12, such as is depicted generally in FIGS. 1 and 6. As will be set forth in greater detail below, when the tab 52 is in its one state, the physical interlock 36 and the electronic interlock 38 are each in their one state.

Figure 11:
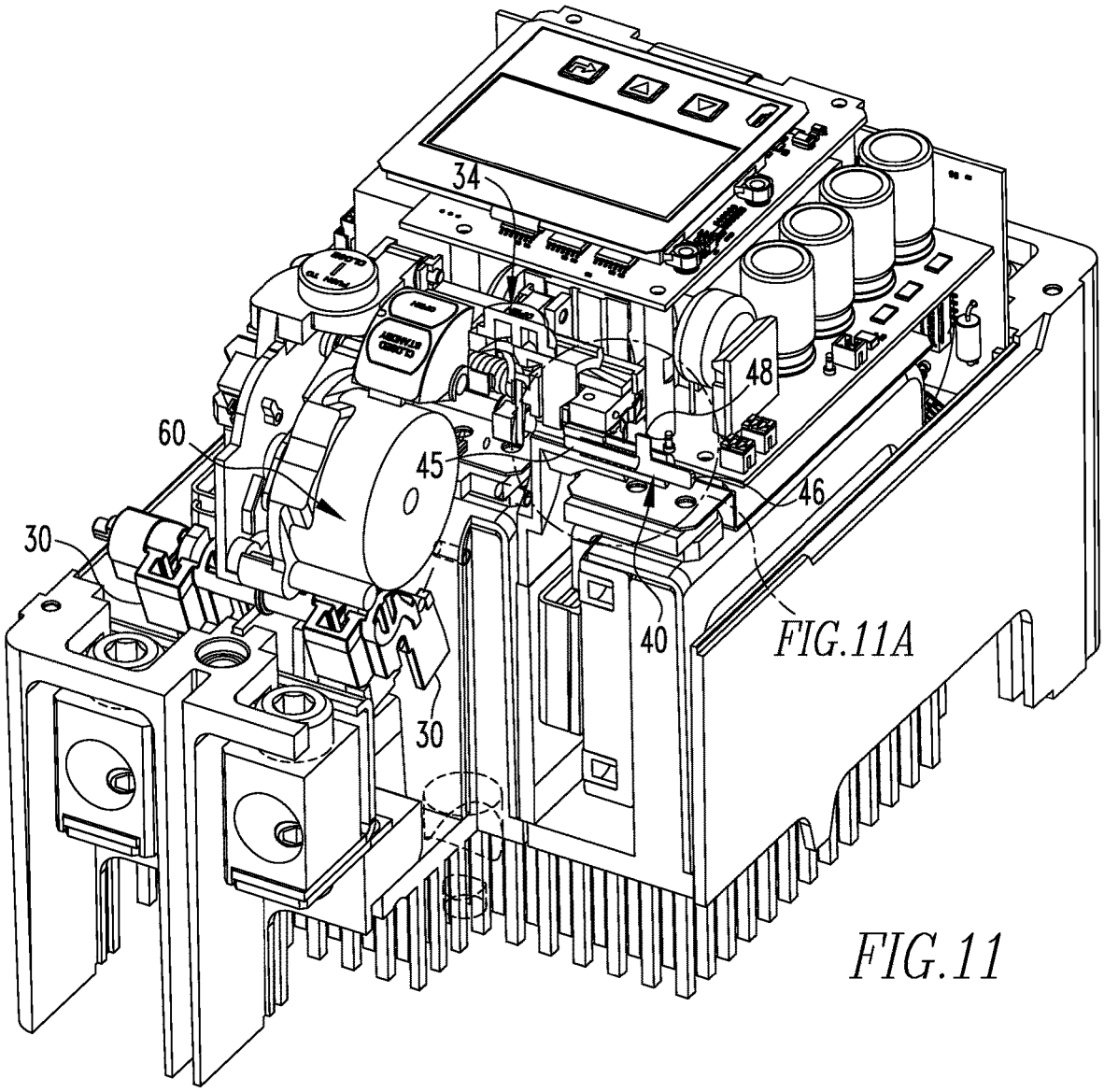
FIG. 11 is a view similar to FIG. 9, except partially cut away.
Figure 11A:
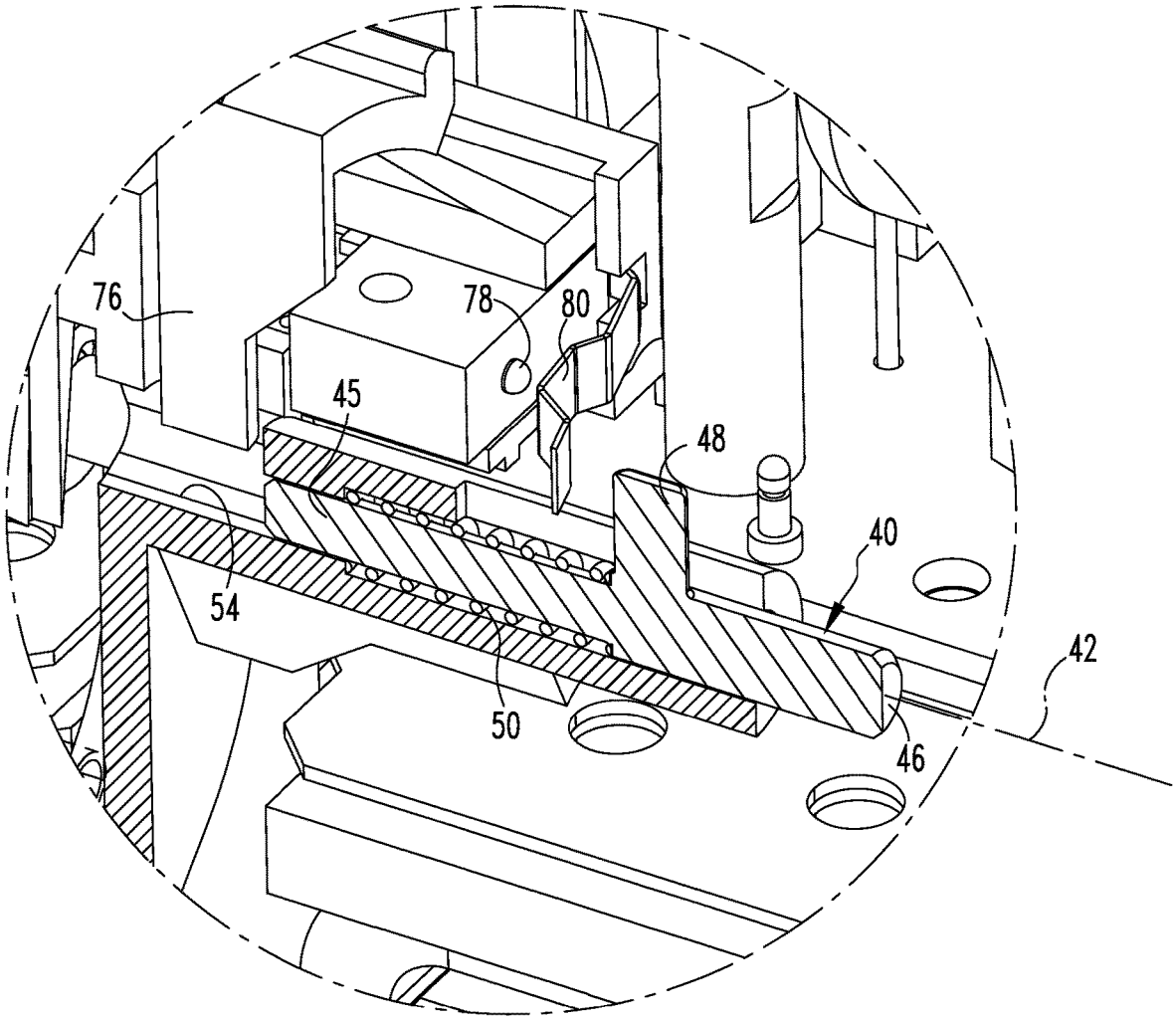
FIG. 11A is an enlarged view of an indicated portion of FIG. 11.
Figure 12:
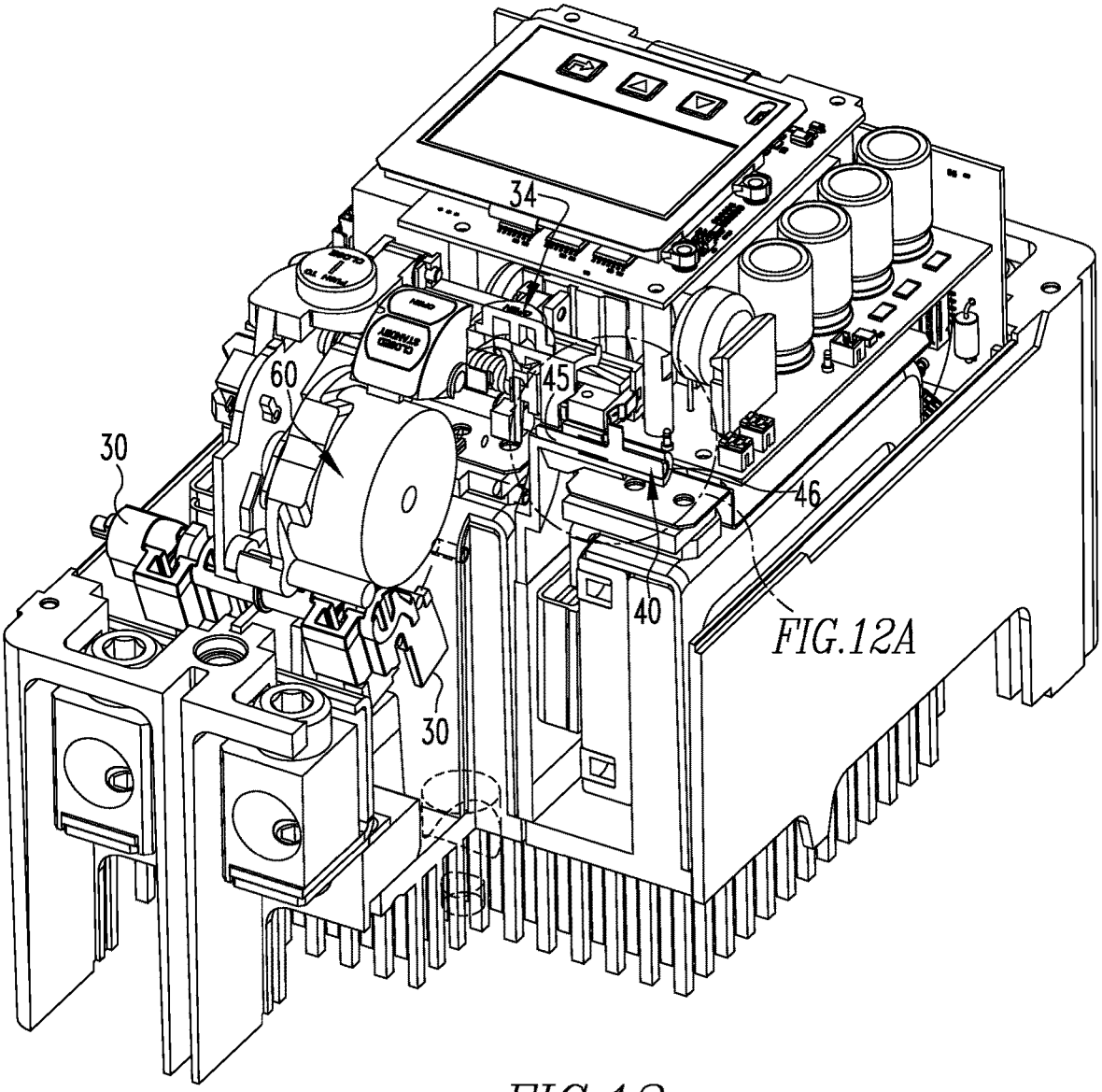
FIG. 12 is a view similar to FIG. 11, except depicting the physical interlock in a resist state.
Figure 12A:
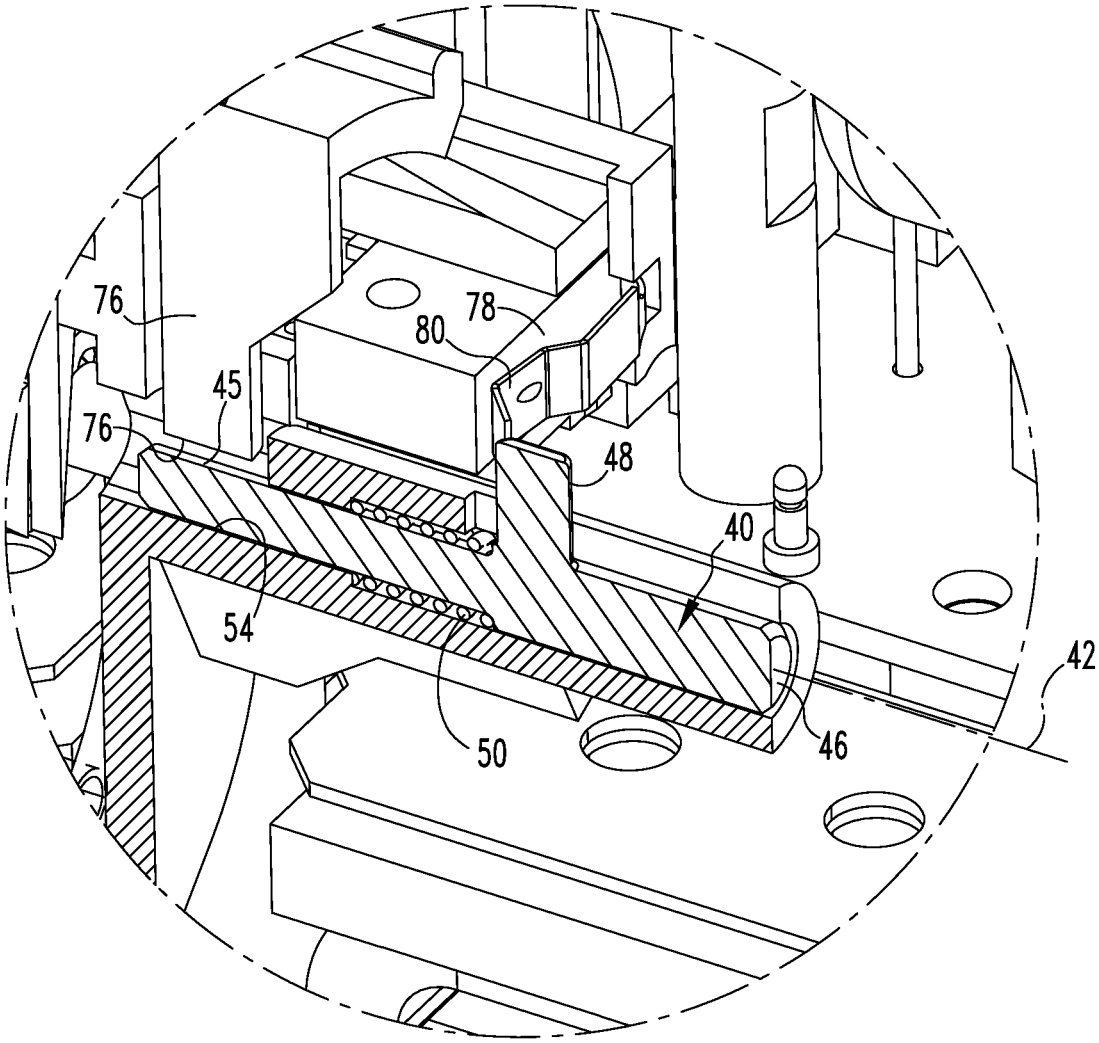
FIG. 12A is an enlargement of an indicated portion of FIG. 12.

The shank 40 is an elongated structure that moves and, more particularly, reciprocates, along an axis 42 between the position that is depicted generally in FIGS. 11 and 11A wherein the physical interlock 36 is in its release state and the position depicted generally in FIGS. 12 and 12A wherein the physical interlock 38 is in its resist state. The spring 50 is engaged with the shank 40 and biases the shank toward the release state of the physical interlock 36. As can be understood from FIG. 5, the shank 40 includes an end 46, a blocking portion 45 that is situated generally opposite the end 46, and a lug 48 that is disposed generally between the end 46 and the blocking portion 45 and that protrudes generally outwardly from the shank 40, generally perpendicular to the axis 42. The housing 12 includes a support 54 upon which the shank 40 is movably situated.

Figure 6:
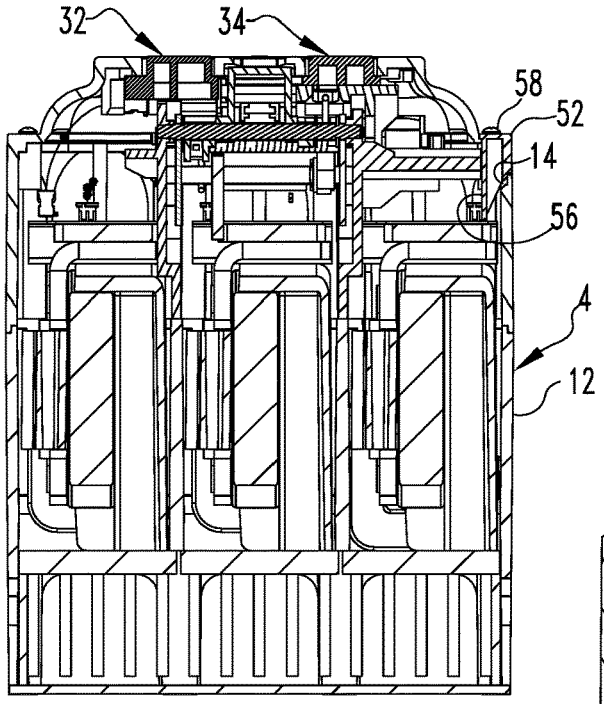
FIG. 6 is a sectional view as taken along lines 6-6 of FIG. 1.
Figure 7:
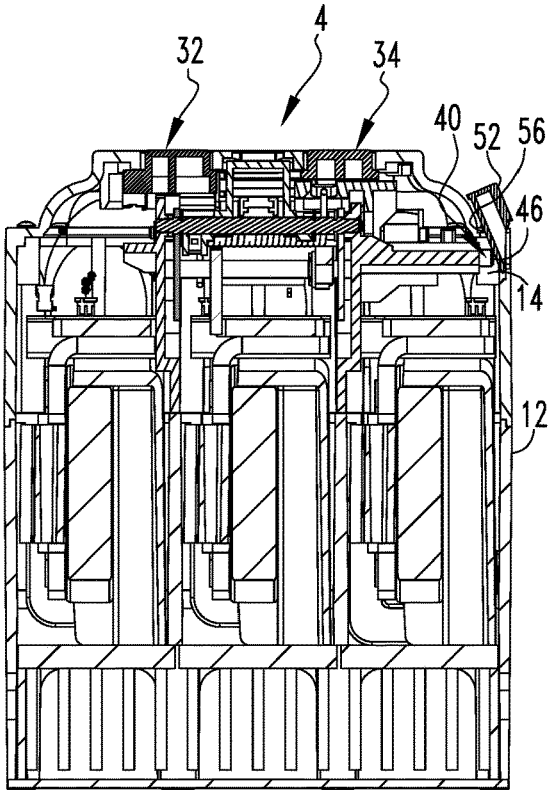
FIGS. 7 and 8 are similar to FIG. 6, except depicting a tab of the interlock apparatus being partially returned from its removed state to it installed state.
Figure 8:
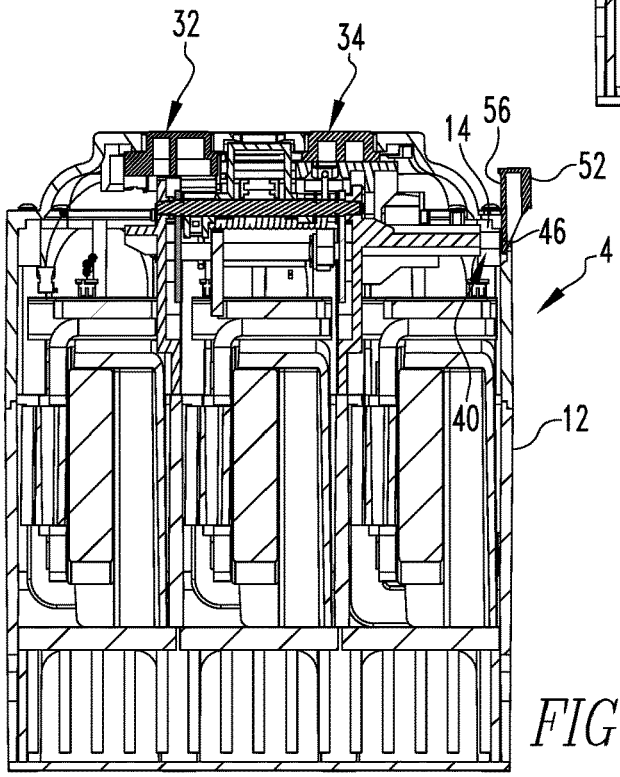

As can be understood from FIGS. 1 and 6, when the tab 52 is in its installed state, the physical interlock 36 is in its resist state. For instance, the tab 52 includes an engagement surface 56 that engages the end 46, such as is illustrated in FIGS. 7 and 8 when the tab 52 is being returned from its removed state to its installed state. In the installed state of the tab 52, the engagement surface 56 is engaged with the end 46 of the shank 40.

The interlock apparatus 24 further includes a fastener 58 in the exemplary form of a threaded screw that retains the tab 52 in the installed state. Once the fastener 58 has been removed, the tab 52 can be removed from the opening 14 formed in the housing 12, possibly with the use of a tool such as slot screwdriver or other tool, if needed, whereupon the engagement surface 56 becomes disengaged from the end 46 of the shank 40, and the spring 50 translated the shank 40 along the axis 42 until the physical interlock 36 is in its release state, such as is depicted generally in FIGS. 11 and 11A. On the other hand, when the tab 52 is returned to the installed state received in the opening 14, the engagement surface 56 engages the end 46 of the shank 40, such as is depicted generally in FIGS. 6 and 8, and continued insertion of the tab 52 into the opening 14 overcomes the bias of the spring 50 to translate the shank 40 along the axis 42 until the physical interlock is in its resist state, such as is depicted generally in FIGS. 12 and 12A.

Further regarding the isolation switch 30, it is noted that the switching apparatus 16 includes a rotational solenoid 60 that has a dual over-centering mechanism and that includes a rotatable armature 64 that is movable between the position that is depicted generally in FIG. 10, which corresponds with the ON state of the isolation switch 30, and another position rotated in the clockwise direction from that which is depicted in FIG. 10, which corresponds with the OFF state of the isolation switch 30. The dual over-centering mechanism biases the armature to either the position depicted in FIG. 10 or the other position situated clockwise therefrom.

Figure 9:
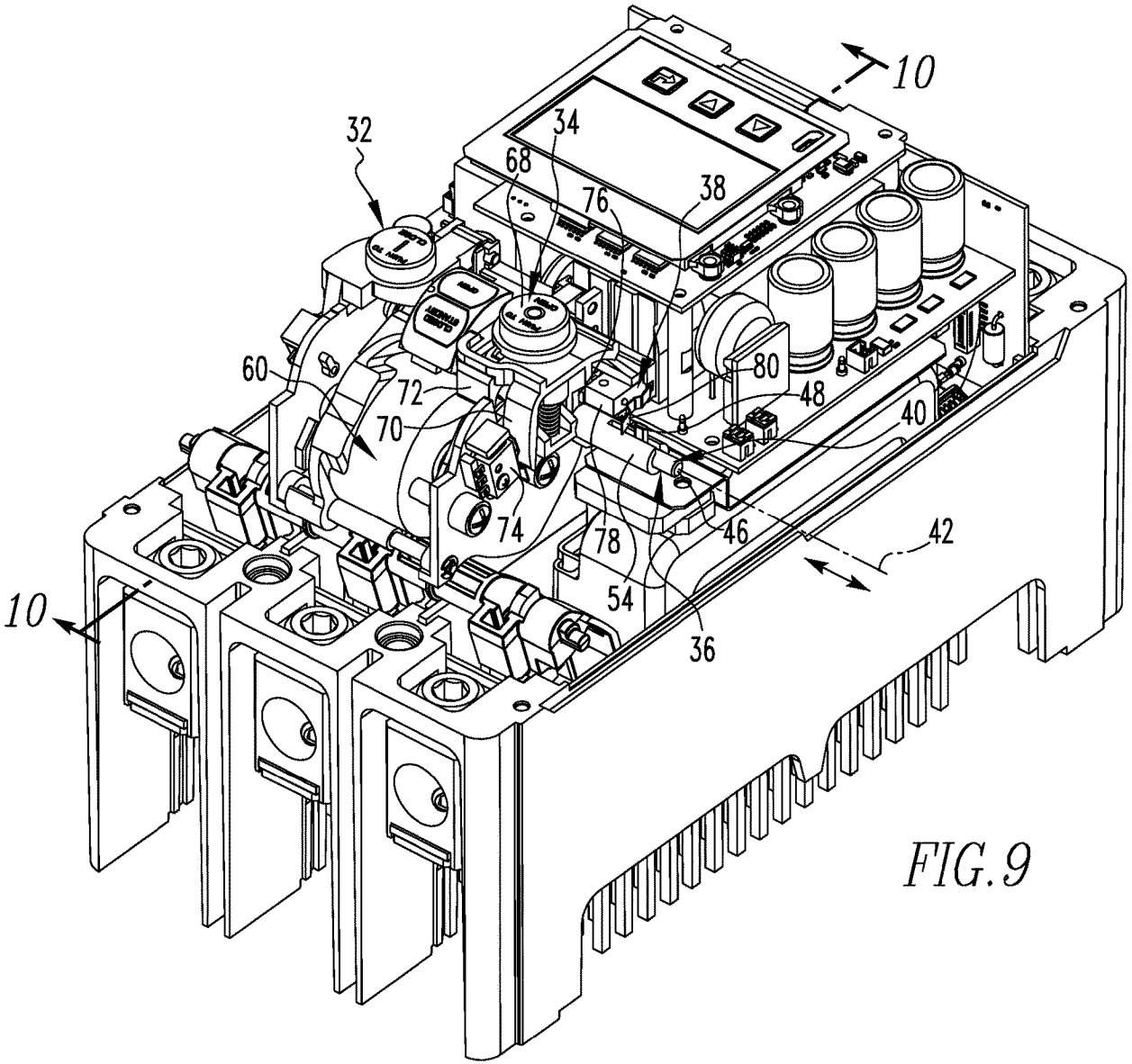
FIG. 9 is a perspective view of the first embodiment with a portion of the cover removed and with a physical interlock of the interlock apparatus being in a release state.

It can be seen, as in FIG. 9, that the OFF actuator 34 includes a button member 68, a first protrusion 70, a second protrusion 72, and a stop 76. As can be understood from FIG. 9, the first and second protrusions 70 and 72 and the stop 76 each depend from the button member 68 in a downward direction from the perspective of FIG. 9. The first protrusion 70 is engageable with a first switch 74, which is a part of the actuator apparatus 20, which electrically energizes the rotational solenoid 60 using auxiliary power at 24 volts DC to cause the armature 60 to rotationally change states, which results in the isolation switch 30 moving from its ON state to its OFF state. Such actuation would occur when the OFF actuator 34 is manually moved from its fee state toward its actuated state sufficiently to engage the first protrusion 70 with first switch 74 to cause the rotational solenoid 60 to become energized and to cause the armature 64 to rotate in the clockwise direction away from that which is depicted in FIG. 10, with such rotation of the armature 64 causing the isolation switch 30 to move from the ON state to the OFF state.

It is noted, however, that if such auxiliary power is unavailable, the aforementioned actuation of the first switch 74 by slightly depressing the OFF actuator 34 away from its free state and toward its actuated state will fail to energize the rotational solenoid 60. According, the armature 64 will not be caused to electrically rotate, thereby leaving the isolation switch 30 in its ON state without an ability to switch it to its OFF state. Such a condition is undesirable because of the potential leakage of current through the solid state switch 28 and thus through the isolation switch 30, with the result that the solid state circuit interrupter 4 typically could not be installed until the isolation switch 30 has been returned to its OFF state.

As such, the second protrusion 72 is advantageously provided in order to physically engage the armature 64, such as is depicted generally in FIG. 10 in order to slightly rotate the armature 64 beyond one of its over-centering positions to cause the armature 64 to perform the aforementioned rotation in the clockwise direction away from the position depicted generally in FIG. 10. This causes the armature 64 to move the isolation switch 30 from the ON state that is represented by the position of the armature 64 in FIG. 10 to a position rotated in the clockwise direction from that depicted in FIG. 10 wherein the isolation switch 30 would be in its OFF state. However, the interlock apparatus 24 is advantageously provided in order to avoid such manual movement of the isolation switch 30 from the ON state to the OFF state until certain conditions exist on the solid state circuit interrupter 4.

More particularly, and as can be understood from FIGS. 12 and 12A, when the physical interlock 36 is in its resist state, such as when the tab 52 is in the installed state received in the opening 14 in the housing 12, the blocking portion 45 of the shank 40 is situated in the path of the stop 76 when the off actuator 34 is sought to be manually moved toward the actuation state a distance beyond the point at which the first protrusion 70 engages the first switch 74 and would cause it to change state. That is, an initial manual actuation of the OFF actuator 34 from the free state toward the actuated state causes the first protrusion 70 to engage the first switch 74 and to cause the first switch 74 to change states.

Further actuation of the OFF actuator 34 toward the actuated state causes the stop 76 to engage the blocking portion 45 of the shank 40 when the physical interlock 36 is in the resist state, such as is depicted generally in FIGS. 12 and 12A. However, when the tab 52 has been moved to its removed state, such as is depicted generally in FIGS. 2 and 4, which permits the spring 50 to translate the shank 40 along the axis 42 until the physical interlock 36 is in its release state, such as is depicted generally in FIGS. 11 and 11A, the stop 76 is not blocked by the blocking portion 45, thereby permitting the stop 76 to be received in the region of the support 54 that has been vacated by the blocking portion 45 and to cause the second protrusion 72 to engage the armature 64, such as is depicted generally in FIG. 10. As mentioned hereinbefore, in view of the dual over-centering configuration of the rotational solenoid 60, a very slight rotation of the armature 64 in the clockwise direction, from the perspective of FIG. 10, due to the second protrusion 72 engaging the armature 64 in the ON state of the isolation switch 30 causes the armature 64 to rotate in the clockwise direction from the perspective of FIG. 10 away from the position that is depicted in FIG. 10 to its alternate rotational position, whereupon the armature 64 moves the isolation switch 30 from the ON state to the OFF state. It thus can be understood that when the tab 52 is in its installed state, such as is depicted generally in FIG. 1, the engagement of the stop 76 with the blocking portion 45 of the shank 40 resists engagement of the second protrusion 72 with the armature 64, thereby resisting manual movement of the isolation switch 30 from the ON state to the OFF state. However, upon movement of the tab 52 from the installed state of FIG. 1 to the removed state of FIGS. 2 and 4, the physical interlock 36 is moved from its resist state of FIGS. 12 and 12A to its release state of FIGS. 11 and 11A, which permits the OFF actuator 34 to be actuated a greater distance sufficient to cause the second protrusion 72 to physically engage the armature 64 and to cause the armature 64 to rotate and to thereby change the state of the isolation switch 30 from its ON state to its OFF state.

It is furthermore noted that the electronic interlock 38 includes a second switch 78 that is depicted generally in FIG. 5 and that is operated by a flap 80 that is likewise depicted in FIG. 5 and which itself is operated by the lug 48 of the shank 40. More specifically, and as can be understood from FIGS. 11A and 12A, when the physical interlock 36 is in its resist state, such as is depicted generally in FIG. 12A, the lug 48 engages the flap 80 which, in turn, engages the second switch 78 to place the electronic interlock 38 in its release state. In such a condition, the ON actuator 32 is operable to engage an additional switch that electronically switches the solid state switch 28 from the OFF state to the ON state. However, when the physical interlock 36 is in the release state, such as is depicted generally in FIG. 11A, the lug 48 disengages from the flap 80 which causes the second switch 78 to change states and to thereby cause the electronic interlock 38 to be in its resist state in which condition the solid state switch 32 cannot be switched from the OFF state to the ON state because the additional switch is defeated. As noted hereinbefore, the ON actuator 32 is engageable with the additional switch when the ON actuator 32 is manually moved from its free state toward an actuated state, and such manual movement of the ON actuator 32 to engage the additional switch will typically cause the solid state switch 28 to move from its OFF state to its ON state. However, when the electronic interlock 38 is in its resist state, which occurs when the physical interlock is in its release state, such as is depicted generally in FIGS. 11 and 11A, the additional switch that is being actuated by the ON actuator 32 is defeated such that the solid state switch 28 cannot be switched to its ON state. This condition exists in a situation in which the isolation switch 30 is capable of being manually moved from its ON state to its OFF state by virtue of the physical interlock 36 being in its release state, which occurs when the tab 52 is in its removed state.

It thus can be understood that when the tab 52 has been moved to its removed state to cause the physical interlock 36 to move to its release state, such as depicted in FIGS. 11 and 11A, and in which condition the isolation switch 30 can be manually moved from its ON state to its OFF state by manual actuation of the OFF actuator 34, the electronic interlock 38 is in its resist state which prevents the ON actuator 32 from switching solid state switch 28 from its OFF state to its ON state. This is the case even if the ON actuator 32 is manually moved from its free state toward its actuated state to engage and change the state of the additional switch since the additional switch has been defeated by the electronic interlock 38 being in its resist state. However, upon return of the tab 52 to its installed state and the return of the physical interlock 36 to its resist state, such as is depicted generally in FIGS. 12 and 12A, the engagement of the lug 48 with the flap 80 and, in turn, the engagement of the flap 80 with the second switch 78, causes the second switch 78 to change states to thereby cause the electronic interlock to be in its release state. This permits a manual actuation of the ON actuator 32 and the engagement of the ON actuator 32 with the additional switch to electronically switch the solid state switch 32 from its OFF state to its ON state.

The interlock apparatus 24 thus advantageously resists manual movement of the isolation switch 30 from the ON state to the OFF state in a situation where the solid state switch 28 is capable of being moved by the ON actuator 32 from its OFF state to its ON state. Similarly, the interlock apparatus 24 advantageously resists the solid state switch 28 from being switched from its OFF state to its ON state in a situation where the isolation switch 30 is permitted to be switched from its ON state to its OFF state. These advantageously resist the isolation switch 30 from being switched from its OFF state to its ON state when the solid state switch 28 is in its ON state, which advantageously avoids destruction of the isolation switch 30 due to the arc that would be created within the open contacts of the isolation switch 30 when it is the last electrical link in closing a circuit. This advantageously avoids destruction of the solid state circuit interrupter 4, and such avoidance is advantageous.

An improved solid state circuit interrupter 104 in accordance with a second embodiment of the disclosed and claimed concept is depicted generally in FIGS. 13-16. The solid state circuit interrupter 104 is similar to the solid state circuit interrupter 4, except it includes some additional features. As such, features of the solid state circuit interrupter 4 that are common with the solid state circuit interrupter 104 are removed from FIGS. 13-16 for reasons of simplicity of disclosure.

The solid state circuit interrupter 104 includes an interlock apparatus 124 that is similar to the interlock apparatus 24, except that the interlock apparatus 124 includes an additional physical interlock. The solid state circuit interrupter 104 includes a switching apparatus 116 and an actuator apparatus 120 that are similar to the switching apparatus 16 and the actuator apparatus 20 of the solid state circuit interrupter 4. That is, the switching apparatus 116 has a solid state switch 128 and an isolation switch 130 for each pole thereof that are similar to the solid state switch 28 and the isolation switch 30. In a similar fashion, the actuator apparatus 120 includes an ON actuator 132 and OFF actuator 134 that are similar to the ON and OFF actuators 32 and 34.

The interlock apparatus 124 includes an electronic interlock 138 that is similar to the electronic interlock 38 and a first physical interlock 136 that is similar to the physical interlock 36. However, the interlock apparatus 124 additionally includes a second physical interlock 182 that is cooperable with the ON actuator 132.

The first physical interlock 136 includes a first shank 140 that is similar to the shank 40 and which is elongated and reciprocates along a first axis 142. The first shank 140 includes a lug 148 that is similar to the lug 48 and which cooperates with the electronic interlock 138, but the lug 148 additionally and advantageously physically cooperates with the second physical interlock 182.

More particularly, the physical interlock 182 includes a second shank 184 that is elongated and that reciprocates along a second axis 185 that is oriented parallel with the first axis 142. The second physical interlock 182 further includes a crank 186 that is situated on a housing 112 of the solid state interrupter 104 and is pivotable with respect to the housing 112. The crank 186 includes a first leg 188 that is cooperable with the lug 148 and further includes a second leg 192 that is cooperable with the second shank 184. The crank 186 is pivotable about a pivot 194 that is situated between the first and second legs 188 and 192.

The second shank 184 additionally includes a blocking portion 190 which, in certain circumstances, is positioned to resist the ON actuator 132 from being manually moved from its free state to an actuated state. That is, the ON actuator 132 can be said to include a button member 196 and a stop 198, with the stop 198 depending downwardly from the button member 196 from the perspective of FIGS. 13-16. The second physical interlock 182 is similar to the first physical interlock 136 in that the second physical interlock 182 is movable with respect to the ON actuator 132 between one state and another state in cooperation with the movement of the first physical interlock 136 between its one state and its another state, and with such movement of the first physical interlock 136 being communicated via the lug 148 to the second physical interlock 182, specifically by engagement of the lug 148 with the first leg 188 of the crank 186.

Figure 13:
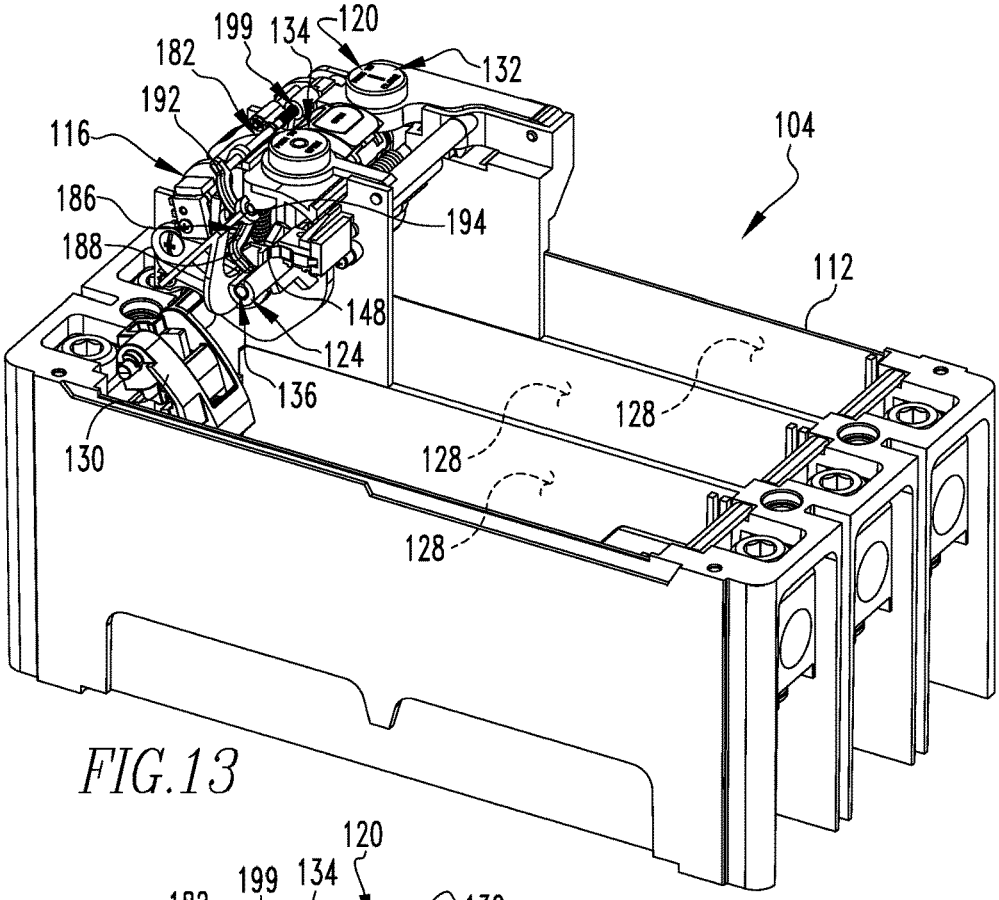
FIG. 13 is a view of a solid state circuit interrupter in accordance with a second embodiment that is similar in certain respects to the first embodiment and that has certain components that are in common with the first embodiment removed therefrom, and that depicts its interlock apparatus as having a first physical interlock in a resist state and as having a second physical interlock in a release state.
Figure 14:
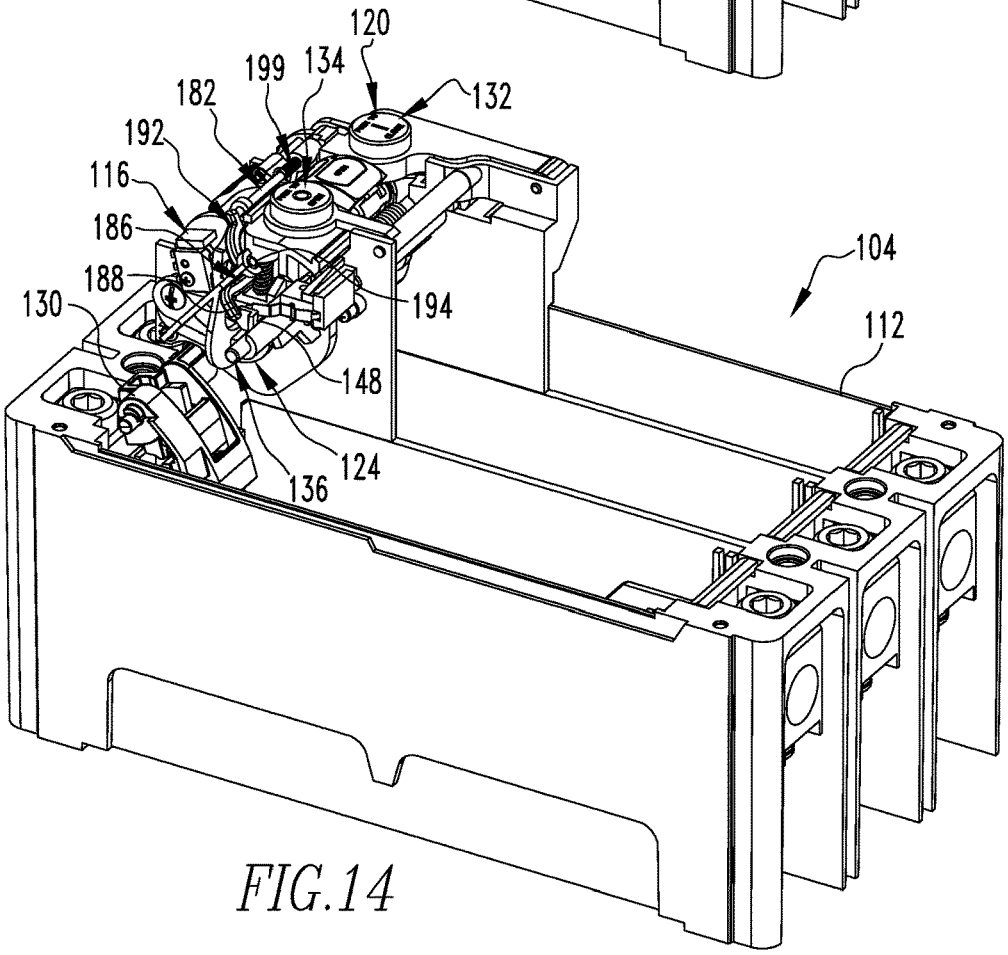
FIG. 14 is a view similar to FIG. 13, except depicting the first physical interlock in a release state and depicting the second physical interlock in a resist state.
Figure 15:
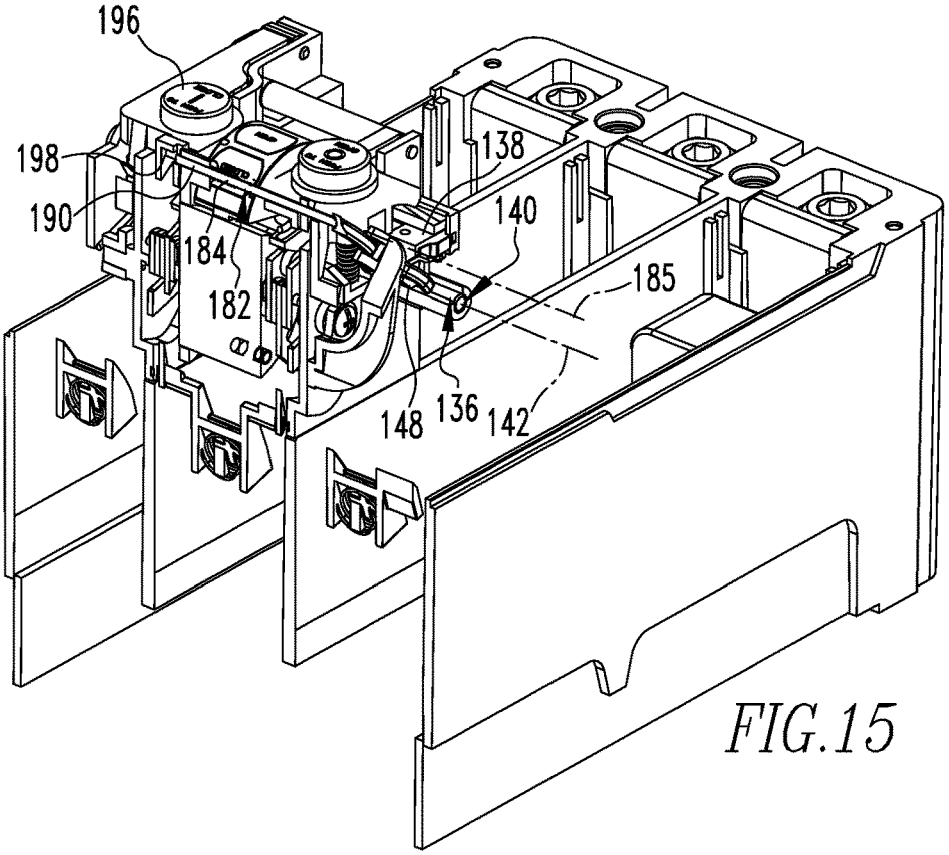
FIG. 15 is another view of the second embodiment partially cut away and with the first and second physical interlocks being in the same states as depicted in FIG. 13.
Figure 16:
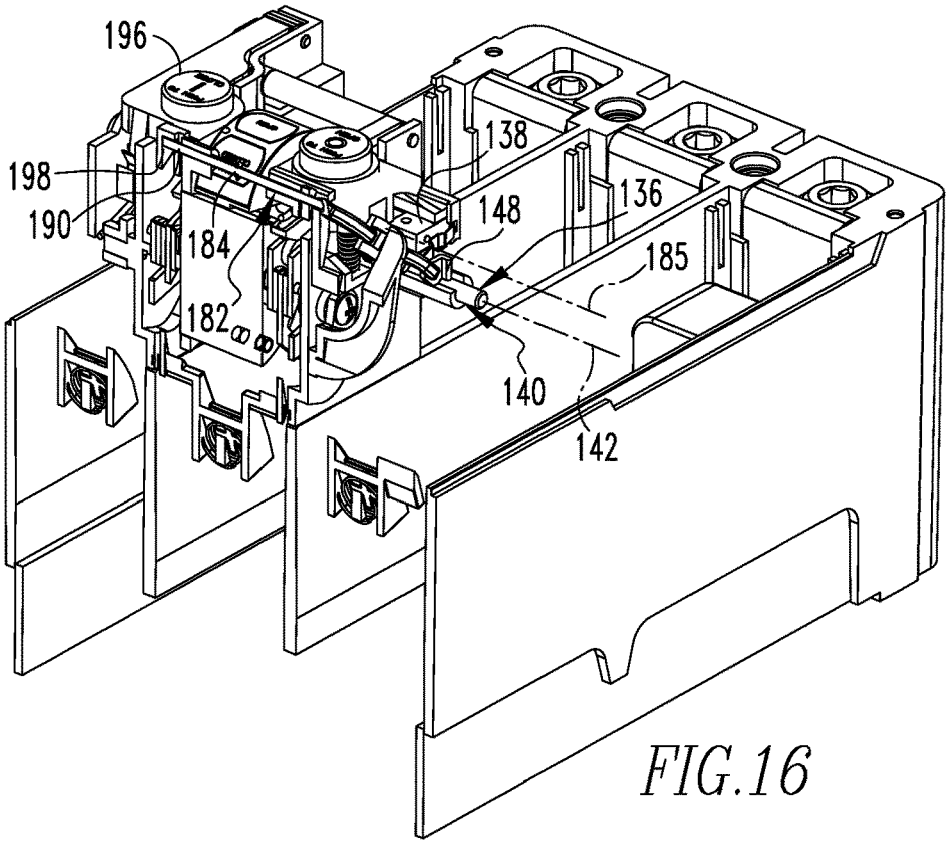
FIG. 16 is a view similar to FIG. 15, except depicting the first and second physical interlocks having the same states as depicted in FIG. 14.

When the first physical interlock 136 is in its one state, which is a release state, such as is depicted in FIGS. 14 and 16, the second physical interlock 182 is in its own one state, except that the one state of the second physical interlock 182 is a resist state wherein the blocking portion 190 of the second shank 184 is situated beneath the stop 198 of the ON actuator 132 and interferes with manual movement of the ON actuator 132 from its free state to an actuated state. However, when the first physical interlock 136 is in its another state, which is a resist state, such as is indicated generally in FIGS. 13 and 15, the second physical interlock 182 is likewise in its another state. It is noted that the another state of the second physical interlock 182 is a release state wherein the second shank 184 is reciprocated sufficiently that the blocking portion 190 is no longer in a position to be engaged by the stop 198 of the ON actuator 132. It is further noted that the second physical interlock 182 additionally includes a spring 199 that biases the second shank 184 and thus the second physical interlock 182 toward the another state. Such biasing also assists in maintaining engagement between the lug 148 and the first leg 188.

It thus can be seen that the second physical interlock 182 that is provided in the interlock apparatus 124 is in a resist position that resists manual actuation of the ON actuator 132 when the first physical interlock 136 is in its release position, such as is depicted in FIGS. 14 and 16. It is noted that the release position of the first physical interlock 136 permits manual actuation of the OFF actuator 134 to an actuated state where the second protrusion 72 can physically engage the armature 64 to manually switch the isolation switch 30 from its ON state to its OFF state, such as is depicted in FIG. 10 in the context of the first embodiment, and which operates in the same fashion in the second embodiment. However, when the first physical interlock 136 is in its resist state, the second physical interlock 182 is in its release state, such as is depicted in FIGS. 13 and 15. In such a situation, i.e., when the second physical interlock 182 is in its release state, the ON actuator 132 is manually movable from its free state to an actuated state wherein the ON actuator 132 physically engages the armature 64 to move the isolation switch 130 from its OFF state to its ON state. Such manual actuation of the armature 64 with the ON actuator 132 is a feature that is provided in the solid state circuit interrupter 104 that is absent from the solid state circuit interrupter 4.

As such, in the one state of the first and second physical interlocks 136 and 182, the armature 64 can be physically engaged by the OFF actuator 134 to switch the isolation switch 130 from its ON state to its OFF state, and actuation of the ON actuator 132 is resisted due to the presence of the blocking portion 190 of the second shank 184 in the path of the stop 198 of the ON actuator 132. However, in the another state of the first physical interlock 136 and the second physical interlock 182, manual actuation of the OFF actuator 134 is resisted by the first shank 140 whereas the blocking portion 190 is no longer in an interfering position with the stop 198, thereby permitting the ON actuator 132 to be manually moved from the free state to the actuated state to physically engage the armature 64 to move the isolation switch 130 from its OFF state to its ON state. As noted elsewhere herein, the solid state circuit interrupter 4 does not provide functionality whereby the ON actuator 132 can be manually actuated to engage the armature 64 to manually move the isolation switch 30 from its OFF state to its ON state. However, the solid state circuit interrupter 104 does provide such functionality and additionally provides the second physical interlock 182 to resist such manual actuation of the ON actuator 132 if the first physical interlock 136 is in its release state.

An improved solid state circuit interrupter 204 in accordance with a third embodiment of the disclosed and claimed concept is depicted generally in FIGS. 17-22. The solid state circuit interrupter 204 is similar to the solid state circuit interrupter 4, except that the solid state circuit interrupter 204 includes an interlock apparatus 224 that is biased in an opposite direction from that of the interlock apparatus 24 of the solid state circuit interrupter 4. While the solid state circuit interrupter 204 includes a housing 212 having an opening 214 that are similar to the housing 12 and opening 14 of the solid state circuit interrupter 4, the interlock apparatus 224 includes tab 252 that is different than the tab 52 due to the opposite bias of the interlock apparatus 224 compared with the interlock apparatus 24. As before, since the solid state circuit interrupter 204 includes numerous components in common with the solid state circuit interrupter 4, similar components between the two circuit interrupters have been removed from FIGS. 19-22 for reasons of simplicity of disclosure.

As with the solid state circuit interrupter 4, the interlock apparatus 224 of the solid state circuit interrupter 204 includes a physical interlock 236 and an electronic interlock 238, with the physical and electronic interlocks 236 and 238 being movable between one state and another state. As with the solid state circuit interrupter 4, the physical interlock 236 in the one state is in a release state and the electronic interlock 238 in the one state is in a resist state, whereas in the another state the physical interlock 236 is in a resist state and in the another state the electronic interlock 238 is in a release state. The physical interlock 236 includes a shank 240 that reciprocates along an axis, but the shank 240 is biased by a spring 250 toward the another state, i.e., toward the resist state.

Figure 18:
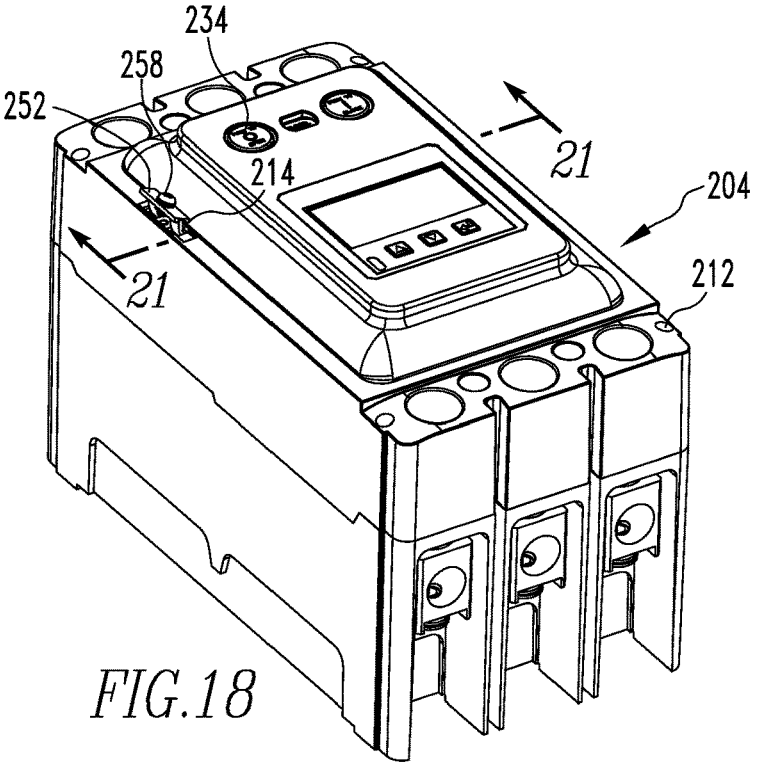
FIG. 18 is another perspective view of the third embodiment, except depicting the physical interlock in a release state.
Figure 19:
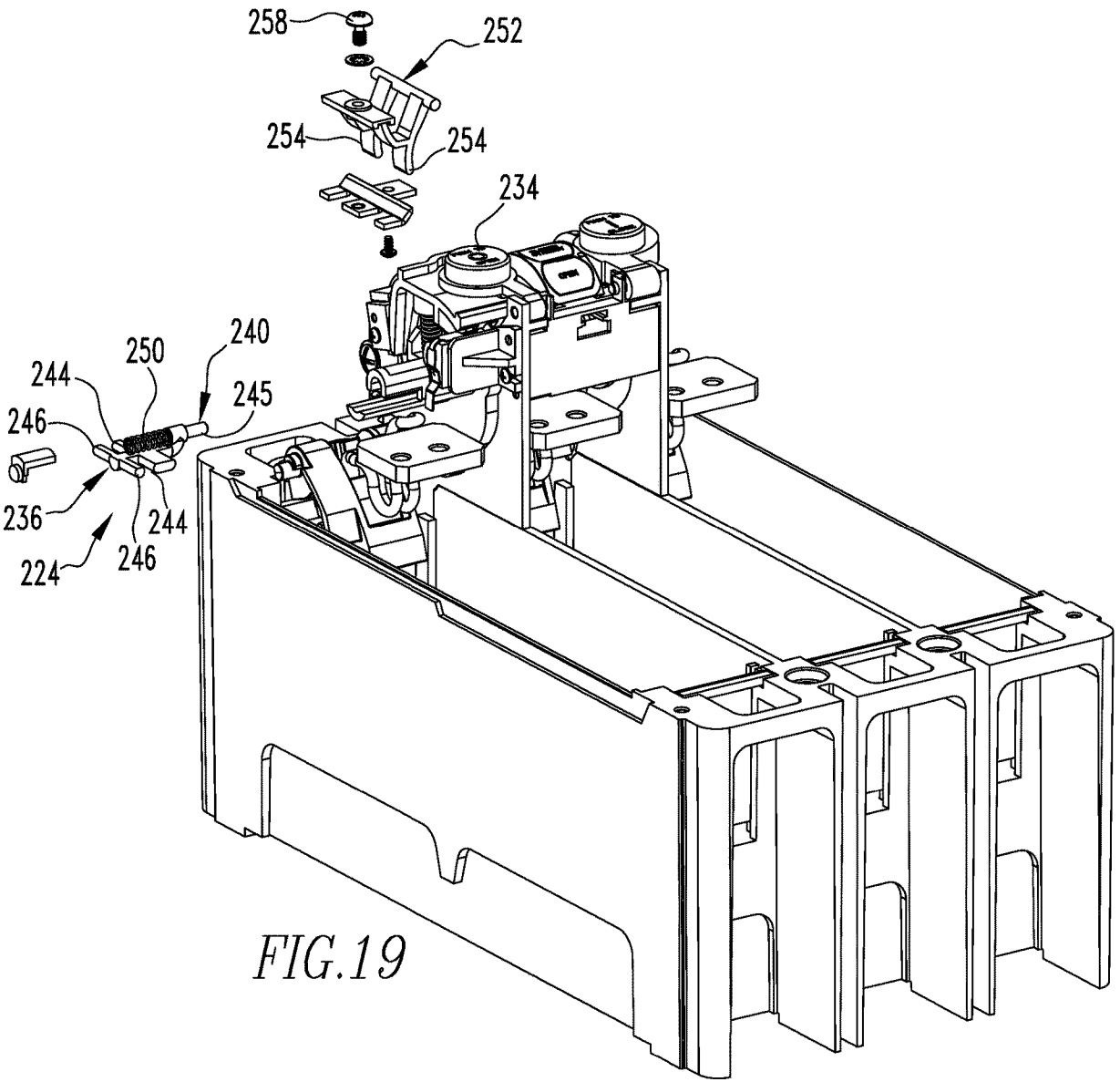
FIG. 19 is a perspective view of the third embodiment in a partially exploded condition and with portions thereof that are in common with the first embodiment being removed therefrom.
Figure 20:
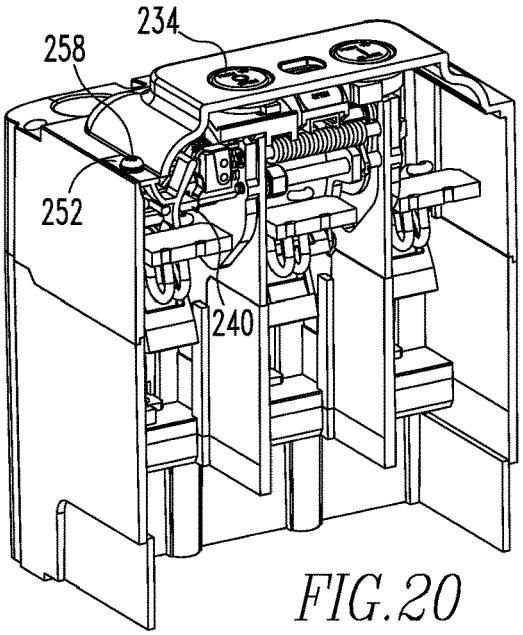
FIG. 20 is a sectional view as taken along line 20-20 of FIG. 17.
Figure 21:
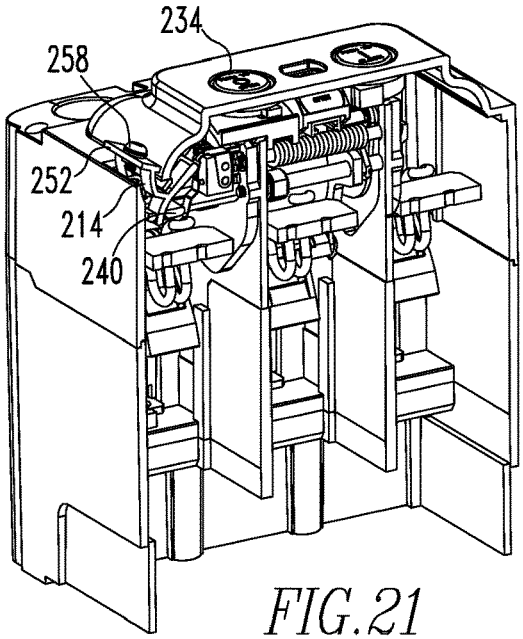
FIG. 21 is a sectional view as taken along line 21-21 of FIG. 18.
Figure 22:
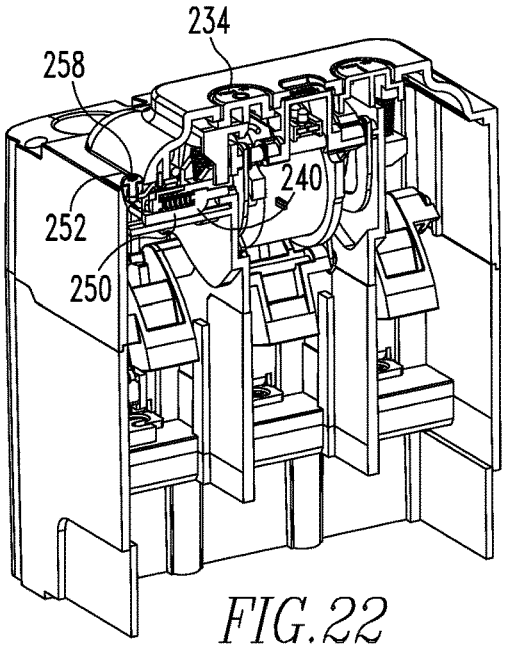
FIG. 22 is a sectional view as taken along line 22-22 of FIG. 17.

The shank 240 includes a pair of receptacles 244 formed therein that are situated adjacent a pair of abutments 246, as is indicated in FIG. 19, and the tab 252 includes a pair of prongs 254 that are movably received in the receptacles 244 and which are engageable with the abutments 246 when moving toward the one state, i.e., the release state. A spring 250 biases the shank 240 toward the another state, i.e., the resist state, wherein a blocking portion 245 of the shank 240 is situated in a path of an OFF actuator 234 that resists the OFF actuator 234 from physically engaging the armature 64 to manually move the isolation switch 30 from the ON state to the OFF state. However, when the bias of the spring 250 is overcome by pivoting the tab 252 from the another state, such as is depicted in FIG. 17, to the one state, such as is depicted in FIG. 18, the blocking portion 245 no longer resists manual movement of the OFF actuator 234 from the free state to the actuated state where the OFF actuator 234 physically engages the armature 64 to pivot the armature 64 and to manually move the isolation switch 30 from the ON state to the OFF state.

Figure 17:
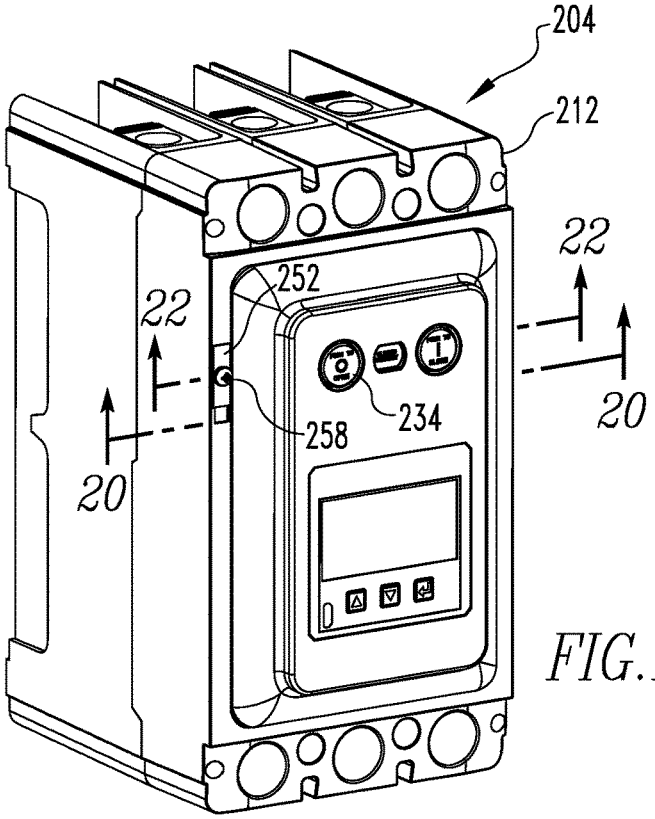
FIG. 17 is a perspective view of an improved solid state circuit interrupter in accordance with a third embodiment of the disclosed and claimed concept and having a physical interlock in a resist state.

Since the physical interlock 236 biases the shank 240 and thus the tab 252 to the position shown generally in FIG. 17, i.e., the another state, the solid state circuit interrupter 204 is moved to the one state by first loosening a fastener 258 that is captured on the tab 252 and inserting an appropriate tool such as a slot screwdriver or other appropriate tool between the exposed portion of the tab 252 and the housing 212 surrounding the opening 214 to overcome the bias of the spring 250 and to pivot the tab 252 to the one position that is depicted generally in FIG. 18. Again, such movement of the tab 252 to change the physical interlock 236 from its another state to its one state, such as is depicted in FIG. 18, removes the blocking portion 245 of the shank 240 from a position of interference with the OFF actuator 234 and thus permits the OFF actuator 234 to be manually moved from its free state to its actuated state to engage the armature 64 to manually move the isolation switch from its ON state to its OFF state. When the force supplied by the slot screwdriver or other appropriate tool is removed from the tab 252, the spring 250, which biases the physical interlock 236 toward the another state, moves the shank 240 such that its blocking portion 245 is situated in a position interfering with manual actuation of the OFF actuator 234 from the free state to its actuated state where it otherwise would physically engage the armature 64. The fastener 258 is a captive fastener which remains on the tab 252.

It therefore can be seen that the various solid state circuit interrupters 4, 104, and 204 permit manual movement of the armature 64 to change the state of the isolation switch 30 in the absence of auxiliary power in certain predefined circumstances. Specifically, manual movement of the isolation switch 30 from its ON state to its OFF state is permitted so long as the solid state switch 28 cannot be moved from its OFF state to its ON state. This is accomplished through use of the physical interlock 36 in cooperation with the electronic interlock 38. In the case of the solid state circuit interrupter 104, the second physical interlock 182 is provided in order to avoid manually moving the isolation switch from its OFF state to its ON state through actuation of the ON actuator 132 when the OFF actuator 134 is capable of being actuated to move the isolation switch from its ON state to its OFF state in the absence of auxiliary power. Such manual actuation of the armature 64 with the ON actuator 132 is a feature that is unique to the solid state circuit interrupter 104. The function of the solid state circuit interrupter 204 is substantially the same as that of the solid state circuit 4, except that the interlock apparatus 224 is biased toward its resist state, and a force must be applied to the tab 252 in order to overcome the bias of the spring 250 to move the physical interlock 236 from its resist state to its released state.

The various solid state circuit interrupters 4, 104, and 204 thus advantageously permit the manual switching of an isolation switch on each pole between ON and OFF states in the absence of auxiliary power. However, the solid state circuit interrupters 4, 104, and 204 advantageously provide interlock features that limit the ability to change the state of the isolation switch until certain circumstances exist. This avoids destruction of the solid state circuit interrupter and enables advantageous changing of the state of the isolation switch in the absence of auxiliary power. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A solid state circuit interrupter structured to be connected with a number of line and load conductors, the solid state circuit interrupter comprising:

a housing;

a switching apparatus situated on the housing and comprising an isolation switch movable between an ON state and an OFF state and a solid state switch movable between an ON state and an OFF state;

an interlock apparatus situated on the housing, the interlock apparatus comprising an interlock that is movable between one state and another state;

an actuator apparatus situated on the housing, the actuator apparatus comprising an actuator, the actuator in the one state of the interlock being structured to be manually movable between a free state and an actuated state to move the isolation switch from the ON state to the OFF state, the interlock in the another state resisting the actuator from moving the isolation switch from the ON state to the OFF state; and wherein the interlock in the one state resists the solid state switch from moving from the OFF state to the ON state.

2. The solid state circuit interrupter of claim 1 wherein the interlock comprises a shank that is movable with respect to the actuator between one position in the one state of the interlock and another position in the another state of the interlock, the shank in the another state being structured to resist the actuator from being manually moved from the free state to the actuated state.

3. The solid state circuit interrupter of claim 2 wherein the interlock comprises a spring that biases the shank toward one of the one position and the another position.

4. The solid state circuit interrupter of claim 2 wherein the shank reciprocates along an axis between the one position and the another position.

5. The solid state circuit interrupter of claim 1 wherein the interlock comprises a shank that is movable with respect to the actuator between one position in the one state of the interlock and another position in the another state of the interlock, the shank in the another state being structured to resist the actuator from being manually moved from the free state to the actuated state.

6. The solid state circuit interrupter of claim 1 wherein the actuator apparatus comprises another actuator and another interlock, the another interlock being movable between one state in the one state of the interlock and another state in the another state of the interlock, the another actuator in the another state of the another interlock being structured to be manually movable between another free state and another actuated state to move the isolation switch from the OFF state to the ON state, the another interlock in its one state resisting the another actuator from moving the isolation switch from the OFF state to the ON state.

7. The solid state circuit interrupter of claim 6 wherein the interlock comprises a shank that is movable with respect to the actuator between one position in the one state of the interlock and another position in the another state of the interlock, the shank in its another state being structured to resist the actuator from being manually moved from the free state to the actuated state, and wherein the another interlock comprises another shank that is movable with respect to the another actuator between one position in the one state of the another interlock and another position in the another state of the another interlock, the another shank in its one state being structured to resist the another actuator from being manually moved from the another free state to the another actuated state.

8. The solid state circuit interrupter of claim 7 wherein the shank reciprocates along an axis between its one position and its another position, and wherein the another shank reciprocates along another axis between its one position and its another position.

9. The solid state circuit interrupter of claim 8 wherein the axis and the another axis are substantially parallel to one another.

10. The solid state circuit interrupter of claim 9 wherein the interlock apparatus further comprises a connector that extends between the shank and the another shank.

11. The solid state circuit interrupter of claim 9 wherein the connector is pivotably situated on the housing.

12. A solid state circuit interrupter structured to be connected with a number of line and load conductors, the solid state circuit interrupter comprising:

a housing;

a switching apparatus situated on the housing and comprising an isolation switch movable between an ON state and an OFF state;

an interlock apparatus situated on the housing, the interlock apparatus comprising an interlock that is movable between one state and another state;

an actuator apparatus situated on the housing, the actuator apparatus comprising an actuator, the actuator in the one state of the interlock being structured to be manually movable between a free state and an actuated state to move the isolation switch from the ON state to the OFF state, the interlock in the another state resisting the actuator from moving the isolation switch from the ON state to the OFF state;

wherein the interlock comprises a shank that is movable with respect to the actuator between one position in the one state of the interlock and another position in the another state of the interlock, the shank in the another state being structured to resist the actuator from being manually moved from the free state to the actuated state;

wherein the interlock comprises a spring that biases the shank toward one of the one position and the another position; and wherein the interlock comprises a tab that is movable between one state in which the interlock in its one state and another state wherein the tab is situated on the housing and overcomes the bias of the spring to retain the interlock in its another state.

13. The solid state circuit interrupter of claim 12 wherein the tab in its another state is engaged with the shank.

14. The solid state circuit interrupter of claim 13 wherein the tab in its one state is removed from the housing.

15. The solid state circuit interrupter of claim 13 wherein the interlock comprises a fastener that retains the tab in its another state.

16. A solid state circuit interrupter structured to be connected with a number of line and load conductors, the solid state circuit interrupter comprising:

a housing;

a switching apparatus situated on the housing and comprising an isolation switch movable between an ON state and an OFF state;

an interlock apparatus situated on the housing, the interlock apparatus comprising an interlock that is movable between one state and another state;

an actuator apparatus situated on the housing, the actuator apparatus comprising an actuator, the actuator in the one state of the interlock being structured to be manually movable between a free state and an actuated state to move the isolation switch from the ON state to the OFF state, the interlock in the another state resisting the actuator from moving the isolation switch from the ON state to the OFF state;

wherein the interlock comprises a shank that is movable with respect to the actuator between one position in the one state of the interlock and another position in the another state of the interlock, the shank in the another state being structured to resist the actuator from being manually moved from the free state to the actuated state;

wherein the interlock comprises a spring that biases the shank toward one of the one position and the another position; and wherein the interlock comprises a tab that is situated on the housing and is movable between one state in which at least a portion of the tab is spaced from the housing to overcome the bias of the spring and to situate the interlock in its one state, and another state wherein the tab is situated on the housing and the interlock in its another state.

17. The solid state circuit interrupter of claim 16 wherein the interlock comprises a fastener that retains the tab in its another state.

18. The solid state circuit interrupter of claim 16 wherein the shank reciprocates along an axis between the one position and the another position, and wherein the interlock comprises a crank that is pivotably situated on the housing and that is cooperable with the shank to move the shank between the one position and the another position, the tab being situated on the crank.

* * * * *